United States Patent [19]

Furlan et al.

[11] Patent Number: 5,037,729

[45] Date of Patent: Aug. 6, 1991

[54] MULTILAYER PHOTOGRAPHIC ELEMENTS HAVING IMPROVED COATING QUALITY

[75] Inventors: Fulvio Furlan, Savona; Domenico Marinelli, both of Savona, Italy

[73] Assignee: Minnesota Mining and Manufacturing Company, St. Paul, Minn.

[21] Appl. No.: 584,901

[22] Filed: Sep. 19, 1990

[30] Foreign Application Priority Data

Sep. 25, 1989 [IT] Italy ..... 21815 A/89

[51] Int. Cl.[5] ..... G03C 1/76

[52] U.S. Cl. ..... 430/539; 430/523; 430/531; 430/537; 430/961

[58] Field of Search ..... 430/539, 950, 961, 523, 430/531, 537

[56] References Cited

U.S. PATENT DOCUMENTS

| | | | |
|---|---|---|---|
| 4,146,398 | 3/1979 | Arase et al. | 430/539 |
| 4,495,273 | 1/1985 | Pannocchia et al. | 430/539 |
| 4,513,080 | 4/1985 | Helling | 430/539 |
| 4,840,881 | 6/1989 | Watanabe et al. | 430/539 |
| 4,891,308 | 1/1990 | Cho | 430/539 |

*Primary Examiner*—Jack P. Brammer

*Attorney, Agent, or Firm*—Gary L. Griswold; Walter N. Kirn; Mark A. Litman

[57] ABSTRACT

A multilayer photographic element comprising at least one light-sensitive emulsion layer comprising silver halide grains dispersed in a hydrophilic colloid and at least one auxiliary hydrophilic colloid layer, said plurality of layers of different composition being simultaneously coated onto a hydrophobic support from aqueous hydrophilic colloid compositions, presents improved coating quality if at least one auxiliary hydrophilic colloid layer comprises a) an anionic surface active agent, b) at least one of betaine, N-oxide or amide surface active agent the and c) at least one of dispersed droplets of a water-immiscible high-boiling organic solvent, a vinyl addition polymer latex or a highly deionized gelatin.

All the layers can be simultaneously coated from said different hydrophilic colloid aqueous compositions while maintaining a distinct layer relationship and avoiding any coating defects.

12 Claims, No Drawings

MULTILAYER PHOTOGRAPHIC ELEMENTS HAVING IMPROVED COATING QUALITY

FIELD OF THE INVENTION

The present invention relates to multilayer photographic elements, and more particularly to multilayer photographic elements having improved coating quality.

BACKGROUND OF THE ART

Multilayer photographic elements comprise at least one hydrophilic layer (i. e. permeable to aqueous photographic processing solutions) of an emulsion of silver halide grains dispersed in an hydrophilic colloid and at least one auxiliary hydrophilic colloid layer (for example, a filter layer, an external protective layer, an intermediate layer, an antihalation layer), said plurality of layers being coated over a hydrophobic support.

The art of multilayer coating of photographic elements has been highly developed, particularly in the manufacture of photographic elements which comprise a plurality of hydrophilic layers of different composition coated on the hydrophobic support.

These compositions are commonly diluted with a low temperature boiling solvent, such as water, for reducing their viscositY and improving coating quality and speed, and they are coated with a multilayer slide bead coater, a multilayer cascade coater, a multilayer extrusion coater or the like onto a hydrophobic support. This coating operation is followed by a drying process in which the solvent is removed.

U.S. Pat. Nos. 2,761,791, 3,508,947 and 4,001,024 describe methods of multilayer coating whereby a plurality of liquid coating compositions are simultaneously applied to a moving support while maintaining a distinct layer relationship.

A homogeneous coating quality is important for the production of high quality photographic materials, especially for the production of large image areas wherein the worsening of the coating quality causes undesirable defects. This phenomenon of worsening of the coating quality is particularly evident in multilayer photographic elements due to the interaction between the commonly used anionic surface active agents and gelatin which is the generally used hydrophilic colloid. This interaction, which causes an increase of surface tension of the hydrophilic colloid composition, is particularly remarkable in the hydrophilic colloid auxiliary layers comprising at least one of highly deionized gelatins, dispersed droplets of water-immiscible high-boiling organic solvents (oils) used to disperse hydrophobic photographic addenda in the auxiliary layer, or vinyl addition polymer latexes.

The action of water soluble salts, such as soluble $Ca^{++}$ salts, in decreasing the surface tension of the hydrophilic colloid photographic compositions wherein said salts are introduced, is known to the skilled in the art to reduce the coating defects of multilayer photographic elements when several hydrophilic layer forming compositions are coated simultaneously onto a moving support. The addition of water soluble salts, however, causes coalescence of dispersed droplets of oils or vinyl addition polymer latexes and tends to increase the residual moisture content of the photographic element thus causing sticking of the element itself.

U.S. Pat. No. 3,811,889 describes a light-sensitive material comprising a support having coated thereon at least one silver halide emulsion layer containing (a) an anionic polymer having a carboxyl group or an alkali metal salt thereof as a side chain thereof, and (b) at least one of a cationic surface active agent and a betaine-type amphoteric surface active agent. This combination gives the film good antistatic properties.

SUMMARY OF THE INVENTION

It has now been found that a multilayer photographic element comprising at least one light-sensitive emulsion layer comprising silver halide grains dispersed in a hydrophilic colloid and at least one auxiliary hydrophilic colloid layer, said plurality of layers of different composition being simultaneously coated onto a hydrophobic support from aqueous hydrophilic colloid compositions, presents improved coating quality if at least one auxiliary hydrophilic colloid layer comprises an anionic surface active agent, at least one of betaine, N-oxide or amide surface active agents and at least one of dispersed droplets of a water-immiscible high-boiling organic solvent, a vinyl addition polymer latex and a highly deionized gelatin.

According to this invention, all the layers can be simultaneously coated from said different hydrophilic colloid aqueous compositions while maintaining a distinct layer relationship and avoiding any coating defects, such as relief patternings, repellencies or comets.

DETAILED DESCRIPTION OF THE INVENTION

The present invention relates to a multilayer photographic element comprising a support having coated thereon a plurality of hydrophilic colloid layers comprising at least one hydrophilic colloid silver halide emulsion layer and at least one hydrophilic colloid auxiliary layer. At least one of said auxiliary hydrophilic colloid layers comprises an anionic surface active agent, at least one of which is betaine, N-oxide or amide surface active agent. Said auxiliary layer also comprises at least one of dispersed droplets of a water-immiscible high-boiling organic solvent, a vinyl addition polymer latex or a highly deionized gelatin.

Anionic surface active agents, normally used in photography, for example as coating, coagulant or dispersing agents, are surfactants of the type including a hydrophobic group linked to an anionic hydrophilic group directly or by means of a bridge consisting of a divalent organic residue, as expressed by the following formula:

R—A13 X wherein

R is an aliphatic, aromatic or a mixed hydrocarbon residue substituted or not substituted and preferably a linear or branched alkyl group having from 4 to 18 carbon atoms or an aryl group substituted with one or more alkyl groups altogether having from 4 to 18 carbon atoms, A is a chemical bond or a divalent organic residue, preferably a carbonyl, a sulphonyl, an amino or an alkylene group preferably having from 1 to 3 carbon atoms, an oxygen atom or groups consisting of two or more of the above-mentioned groups, such as for example carbonylamino, sulphonylamino, aminocarbonyl, aminosulphonyl, ester or polyoxyalkylene groups preferably containing from 2 to 40 oxyalkylene unities, and X is an anionic group of the sulphonate, carboxylate, phosphate and sulphate type.

Anionic surface active agents of this type are described for example in Schwarz et al. "Surface Active Agents and Detergents", Vol. I and II, Interscience Publ., in the U.S. Pat. Nos. 2,992,108, 3,068,101, 3,201,152 and 3,165,409, in the French Pat. Nos. 1,556,240 and 1,497,930 and in the British Pat. Nos. 580,504 and 985,483.

With betaine, N-oxide or amide surface active agents, all those surfactants which present betaine, N-oxide or amide hydrophilic groups are hereby intended. These groups are preferably linked to a hydrophobic group R by means of a bridge A, as expressed in the following formula:

$$R-A-Z$$

wherein

R and A preferably represent a group of the above-defined type, and

Z preferably represents a betained group, such as for example of the type comprising an ammonium cation and a carboxylate or sulphonate anion, an N-oxide group or an amide group, such as for example an hydroxyalkyleneamide group, such as those represented, for example, by the following formulas:

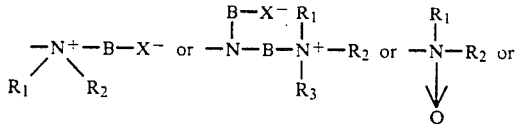

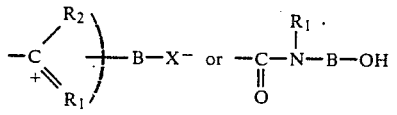

wherein $R_1$, $R_2$ and $R_3$ are hydrogen or alkyl group having from 1 to 10, preferably from 1 to 6 carbon atoms, wherein said alkyl group possibly can be substituted for example with an aryl group, preferably phenyl, $R_1$ and $R_2$ or $R_1$, $R_2$ and $R_3$ altogether also represent the non-metallic atoms necessary to form a heterocyclic quaternized nitrogen nucleus, such as for example pyridinium and imidazolinium, B represents an alkylene group (possibly having a carbon atom replaced with a hetero atom such as a nitrogen atom, a sulfur atom, an oxygen atom, etc.), preferably having 1 to 6 carbon atoms, and X is a carboxylate or sulphonate anion.

Compounds of the anionic surface active agent type, ad defined above, are for example:

1. $C_{12}H_{25}OSO_3Na$

2. 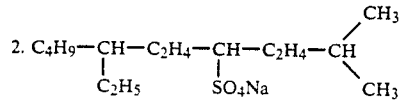

3. 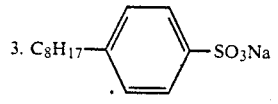

-continued

4. 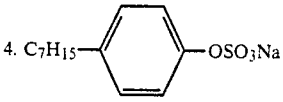

5. 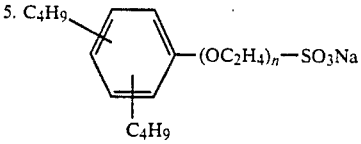

n = 2–40

6. Oleyl-CO—N(CH$_3$)—(CH$_2$)$_2$—SO$_3$Na

7. Stearyl-(OC$_2$H$_4$)$_7$—NHCO—CH$_2$SO$_3$Na

8. 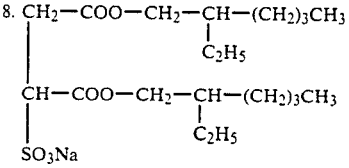

9. 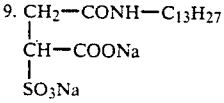

Compounds of this type are sold under registered trade mark, such as for example Teepol TM, Tergitol TM 4, Nekal TM BX, Alrowet TM D65, Maprofix TM LK, Hostapur TM SAS, Aerosol TM OT.

Compounds of the betaine, N-oxide and amide surface active agent type, as defined above, are for example:

10. *cocco-CONH(CH$_2$)$_3$N$^+$(CH$_3$)$_2$CH$_2$COO$^-$
11. stearyl-N$^+$(CH$_3$)$_2$CH$_2$COO$^-$
12. lauryl-N$^+$(CH$_3$)$_2$(CH$_2$)$_3$COO$^-$
13. stearyl-N$^+$(CH$_3$)$_2$(CH$_3$)$_2$SO$_3^-$ 14. *cocco-CONH(CH$_2$)$_3$N(CH$_3$)$_2$ → O 15. lauryl-N(CH$_3$)$_2$ → O 16. 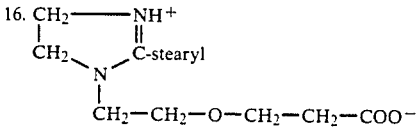

17. 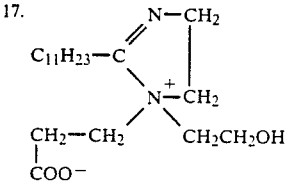

18. 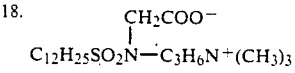

-continued 19. lauryl-CON($CH_2CH_2OH$)$_2$

20. Stearyl-$CONHCH_2CH_2OH$

*cocco represents a mixed blend of groups derived from the reaction of coconut oils with amines. The nature of the resultant composition is about 65% $C_{11}H_{23}$ (lauric acid), 5% $C_{13}H_{27}$ (mirystic acid), 15% $C_{15}H_{31}$ (palmitic acid) and 15% $C_8H_{19}$ (capric acid).

The above listed compounds can be found on the market under registered trade mark, such as for example Tegobetaine TM L7, Velvetex TM, Deriphat TM, Myranol TM 2MCA, Aminoxid TM W35, Ammonix TM LO, Superamide TM L9 and L9C.

In the hydrophilic colloid auxiliary layer according to this invention, said anionic surface active agent is preferably contained in a quantity ranging from 2 to 5 g per 100 g of the hydrophilic colloid of the layer and said betaine, N-oxide or amide surface active agent is preferably contained in a quantity ranging from 1 to 4.5 g per 100 g of the hydrophilic colloid of the layer.

The auxiliary hydrophilic colloid layer according to this invention is formed by coating a hydrophilic colloid aqueous composition comprising in addition to the combination of the above-mentioned surface active agents at least one of dispersed droplets of a water-immiscible high-boiling organic solvent, a vinyl addition polymer latex or a highly deionized gelatin.

The organic solvents which can be used in the auxiliary hydrophilic colloid layer of this invention are defined as non-polymeric organic compounds having a boiling point higher than 200° C. and a water solubility lower than 0.5 g per liter at 25° C., and are ordinarily used in dispersing hydrophobic coupling agents and photographic additives as described, for example, in U.S. Pat. Nos. 2,322,027, 2,501,170, 2,801,171, 2,801,171, 2,272,191, 2,304,940 and 3,748,141. Even though a wide variety of organic solvents can be used, those which are most preferable for the purpose of the present invention (because of the fact that they show no negative effects on the photosensitive material, are easily obtainable and easy to handle because of their excellent stability) have been found to be organic solvents chosen from the class consisting of dibuthylphthalate, tricresylphosphate, triphenylphosphate, di-2-ethylhexylphthalate, di-n-octylphthalate, tris-2-ethylhexylphosphate, cetyltributylcitrate, di-n-hexyladipate, dimethylsebacate, triethyleneglycoldi-2-ethylhexoate, ethylphthalylethylglycolate, quinitolbis(2-ethylhexoate) and 1,4-cyclohexyldimethylene-bis-(2-hexylhexoate).

For the purpose of the present invention, said organic solvents are dispersed in the form of fine droplets (of a size from 0.1 to 1 μm, more preferably from 0.15 to 0.3 μm), which are produced by known methods, the most commonly used method consisting of first dissolving the organic solvent, either alone or in mixture (two or more), in a low temperature boiling solvent (such as methylacetate, ethylacetate, propylacetate, butylacetate, butylpropionate, cyclohexanol, dimethyleneglycolemonoacetate, nitromethane, carbontetrachloride, chloroform, cyclohexane, tetrahydrofuran, methylalcohol, ethylalcohol, propylalcohol, acetonitrile, dimethylformamide, dioxane, acetone, methylethylketone, methylisobutylketone, and the like, used either alone or in combination), then mixing the solution with an aqueous solution of a hydrophilic colloid containing one or more anionic dispersing agents of the type normally used in photography (such as dioctylsodiumsulphosuccinate, sodiumlaurylsulphate, sodiumalkylnaphthalenesulphate and others described in Schwarz et al. "Surface Active Agents and Detergents", Vol. I and II, Interscience Publ., in the U.S. Pat. Nos. 2,992,108, 3,068,101, 3,201,152 and 3,165,409, in the French Pat. Nos. 1,556,240 and 1,497,930 and in the British Pat. Nos. 580,504 and 985,483) and finally dispersing the composition obtained in this manner using a suitable means such as a colloidal mill, a high speed rotating mixer or ultrasonic dispenser. Additionally the organic solvent droplets could include photographic additives of a hydrophilic nature, and more preferably of a hydrophobic nature such as UV absorbers, anti-staining agents, compounds which release developing inhibitors, optical bleaches, anti-oxidants, dyes, color couplers and the like.

In the hydrophilic colloid coating composition used for forming the auxiliary hydrophilic colloid layer according to this invention, said organic solvent is present in proportion by weight of from 10 to 30%, preferably 15 to 20% with respect to the hydrophilic colloid of the coating composition.

The vinyl addition polymers which can be used in the auxiliary hydrophilic colloid layer of this invention are obtained by polymerizing suitable monomers in an emulsion. The preferred monomers are ethylene-unsaturated monomers of the acrylic or methacrylic acid ester type, such as ethylacrylate, methylmethacrylate, methylacrylate, butylmethacrylate, etc., alkyl-substituted acrylamides such as N,N-dibutylacrylamide, N-octylacrylamide, etc., vinyl ester such as vinylacetate, vinylbutyrate, etc., dienes such as butadiene, isoprene, dimethylbutadiene, chloroprene, fluoroprene, etc., aromatic compounds such as styrene, vinyltoluene, etc., vinylhalides such as vinylchloride and vinylidenechloride, acrylonitrile, methacrylonitrile, vinylpyridine, vinylquinoline and other commonly known similar monomers.

These polymers are dispersed in the auxiliary layer of the present invention in the form of very small particles of a size between 0.03 and 0.4 μm, and more preferably between 0.04 and 0.1 μm. Said aqueous dispersions of polymers (latexes) are usually prepared by dispersing one or more of the aforesaid monomers in water in the presence of a dispersing or surface active agent of the type already described heretofore for dispersing the oil, and carrying out polymerization by the use of a water-soluble initiator which is generally a per-compound (ammonium or potassium persulphate, hydrogen peroxide, sodium perborate, etc.), or a redox system such as persulphatebisulphite, or a compound of the α,α'-azobisisobutyroamidine hydrochloride type and α,α'-azobis-4-cyanopentanoic acid (U.S. Pat. Nos. 2,739,137 and 2,599,300 and UK Pat. No. 759,409), or a water-insoluble initiator (such as azo-bis-isobutyronitrile, benzoylperoxide, or cumenehydroperoxide). In preparing the latex, it is often advantageous to use, together with the aforesaid monomers, smaller quantities of water-soluble monomers such as acrylic or methacrylic acid, acrylamide, N-methylacrylamide, methacrylamide, vinylpyrrolidone, vinyloxazolidone, potassium vinylbenzenesulphonate, sodium 3-acryloyloxypropane-1-sulphonate sodium 3-methacryloyloxypropane-1-methylsulphonate or sodium 2-acrylamido-2-methylpropanesulphonate, as described, for example, in BE Pat. No. 869,816.

Preferably, the vinyl addition polymers should have a glass transition temperature of less than 25° C. (the term "glass transition" referring to the characteristic change in the polymer properties from those of a relatively hard, fragile, viteous material to those of a softer, more flexible substance similar to rubber when the temperature is increased beyond the glass transition temperature), the most preferable being the acrylic acid esters chosen from the class comprising polymethylacrylate, polyethylacrylate, polybutylacrylate, polyethoxyethylacrylate, polyhexyl acrylate, polyethylhexylacrylate, polybutylmethacrylate and polyethoxyethylmethacrylate.

In the hydrophilic colloid coating composition used for forming the auxiliary hydrophilic colloid layer according to the present invention, said vinyl addition polymer is present in a weight proportion of from 20 to 50%, preferably 30 to 40% with respect to the hydrophilic colloid of the coating composition.

The highly deionized gelatin which can be used in the auxiliary hydrophilic colloid layer of the present invention is characterized by a higher deionization with respect to the commonly used photographic gelatins. Preferably, said highly deionized gelatin is almost completely deionized, which is defined as meaning that it presents less than 50 ppm (parts per million) of $Ca^{++}$ ions and is practically absent (less than 5 ppm) of other ions such as chlorides, sulphates, phosphates and nitrates, compared with commonly used gelatins having up to 5,000 ppm of $Ca^{++}$ ions and a significant presence of other ions.

In the hydrophilic colloid aqueous compositions used for forming the auxiliary hydrophilic colloid layer, said highly deionized gelatin is present in a weight proportion of at least 30%, preferably at least 50% with respect to the total hydrophilic colloid content of said coating composition.

The hydrophilic colloid of the coating composition is preferably the gelatin commonly used in photographic materials, but other hydrophilic colloids can be used such as protein derivatives, cellulose derivatives, polysaccharides such as starch, sugars such as dextran, synthetic polymers such as polyvinyl alcohol, polyacrylamide and polyvinylpyrrolidone, and other suitable hydrophilic colloids such as those described in U.S. Pat. No. 3,297,446. More preferably said highly deionized gelatin represents at least 90% or all the hydrophilic colloid of the coating composition.

Several hydrophilic colloid photographic compositions including the auxiliary hydrophilic colloid composition according to this invention can be coated simultaneously using processes known in the art, such as those described in U.S. Pat. Nos. 2,761,791 and 4,001,024. FIG. 1 of said patents shows a four slide bead coater by use of which four separate layers of different composition may be simultaneously applied onto a hydrophobic support. In this device, the first coating composition is continuously pumped at a given rate into a cavity from which it is extruded through a narrow vertical slot out onto a downwardly inclined surface over which it flows by gravity to form a layer of that composition. Likewise other coating compositions may be continuously pumped into chambers and may be extruded from narrow vertical slots onto slide surfaces down which they flow by gravity to form separate layers of different composition. The four slide surfaces are coplanar so that as the layers of different coating compositions flow down their respective slide surfaces they are brought together in overlapping relation and by the time the four layers reach the coating bead, they are combined in the desired laminated relationship. This distinct layer relationship is maintained throughout the bead so that as said hydrophobic support is moved across and in contact with the bead by means of a roll, it takes up on its surface the four layers of coating in the desired orientation. There is no limit as to the number of separate layers of coating compositions which may be laid down on said hydrophobic support with this type of apparatus as regard to its potentiality.

In the practice of the present invention, various types of photographic supports may be used to prepare the photographic elements. Suitable supports include polymeric films, such as cellulose nitrate films, cellulose acetate film, polystyrene film, polyvinyl acetal film, polycarbonate film, polyethylene terephthalate film and other polyester films, paper, glass, cloth and the like.

The present invention is suitable for conventional silver halide photographic materials which include at least one silver halide emulsion layer and at least one auxiliary layer. The invention is particularly suitable for conventional color photographic elements of negative or reversal type designed for camera exposure. Said color photographic elements generally include silver halide emulsion layers naturally sensitive (or sensitized) towards blue, and associated with non-diffusing coupling agents forming yellow dyes (with aromatic diamine color development after exposure), silver halide emulsion layers sensitized towards green and associated with non-diffusing coupling agents forming magenta (blue-red) dyes, and silver halide emulsion layers sensitized towards red and associated with non-diffusing coupling agents forming cyan (blue-green) dyes.

Although the invention is particularly suitable for conventional color photographic materials of negative and reversal type, it can be also useful for other color photographic materials characterized by a different arrangement of sensitive layers, such as positive materials for cinema, printing, duplicating, etc. as well as for black and white photographic materials.

The photographic element can also contain chemical sensitizers, spectral sensitizers and desensitizers, optical bleaches, antifoggants and stabilizing agents, coupling agents, screening and antifog dyes, hydrophilic colloid and gelatin substituents, hardeners, spreading agents, plasticizers, antistatic agents and matting agents as known to the expert of the art, and treated in various treatments as described in Research Disclosure 17643, December 1978, which is incorporated herein by reference.

The present invention will be better described and illustrated by the following example of its practice.

EXAMPLE

A multilayer color photographic element (Film A) was prepared by coating the following layers over a subbed cellulose triacetate support in the indicated order.

First layer:

An auxiliary antihalation layer of 1.5 g/m$^2$ of gelatin A (described below), containing 0.25 g/m$^2$ of dispersed black colloidal silver, 0.116 g/m$^2$ of the Hostapur TM SAS93 surface active agent (a $C_{12-14}$ alkyl sodium sulphonate manufactured by Hoechst Co., West Germany) and 14.5 g/m$^2$ of the dispersion 1 (described below).

Second layer:

An auxiliary layer of 0.64 g/m² of gelatin A, containing 1.6 g/m² of the dispersion 2 (described below) and 0.025 g/m² of the anionic surface active agent Hostapur TM SAS93.

Third layer:

A layer of a red sensitive silver bromoiodide emulsion in gelatin A, containing 3.5 g/m² of gelatin A, the cyan couplers A and B (described below) dispersed into fine droplets of dibutylphthalate (oil) in a coupler amount of 0.8 g/m² and an oil amount of 0.3 g/m², and the anionic surface active agent Nekal TM BX (a di-isopropylnaphthalene sulphonate manufactured by BASF Co., West Germany).

A second multilayer color photographic element (Film B) was prepared in a like manner to film A, but with the difference that the second layer coated over the subbed support had the following composition:

An auxiliary layer of 0.64 g/m² of gelatin A, 1.6 g/m² of the dispersion 2 and 0.025 g/m² of the anionic surface active agent Aeroso TM OT75 (a sodium di-isooctylsulphosuccinate manufactured by Cyanamid Co., U.S.A).

A third multilayer color photographic element (Film C) was prepared in a like manner to film A, but with the difference that the second layer coated over the subbed support had the following composition:

An auxiliary layer of 0.64 g/m² of gelatin A, 1.6 g/m² of the dispersion 2, 0.016 g/m² of the anionic surface active agent Hostapur TM SAS93 and 0.009 g/m² of the betaine type surface active agent Tegobetaine TM L7 manufactured by Tego-Tenside Co., West Germany (corresponding to the following formula:

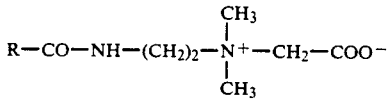

$R=C_{11-17}$).

A fourth multilayer color photographic element (Film D) was prepared in a like manner to film A, but with the difference that the second layer coated over the subbed had the following composition:

An auxiliary layer of 0.64 g/m² of gelatin B, and 0.02 g/m² of the anionic surface active agent Hostapur TM SAS93.

A fifth multilayer color photographic element (Film E) was prepared in a like manner to film A, but with the difference that the second layer coated over the subbed support had the following composition:

An auxiliary layer of 0.64 g/m² of gelatin B, 0.01 g/m² of the anionic surface active agent Hostapur TM SAS93 and 0.01 g/m² of the betaine type surface active agent Tegobetaine TM L7.

Gelatine A was a commonly used photographic gelatin having a viscosity in water (at 40° C. and 6.66% concentration by weight) of 7.5 mPA/s and a concentration of Ca++ ions of 4,000 ppm.

Gelatine B was a highly deionized gelatin having a viscosity in water (at 40° C. and 6.66% concentration by weight) of 6.5 mPA/s and a concentration of Ca++ ions of 40 ppm.

Preparation of dispersion 1

5.26 g of the UV absorber having the following formula:

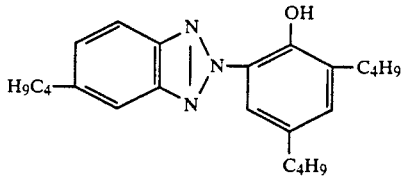

and 1.12 g of the UV absorber having the following formula:

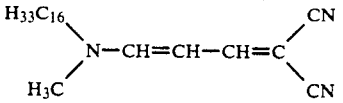

were dissolved in 8.26 g of tricresylphosphate and 4.5 g ethylacetate at 40° C. The obtained solution was added under stirring to 45 cc of an aqueous solution of gelatin A at 10% by weight containing 0.7 g of the anionic surfactant Hostapur TM SAS93, the mixture then being dispersed by means of a rotatory homogenizer to give 100 g of dispersion 1.

Preparation of dispersion 2

2 g of the cyan dye having the following formula:

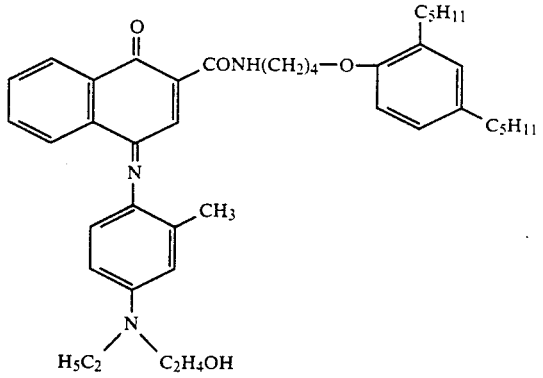

were dissolved in 5.94 g of N,N-dibutylacetanilide and 7.2 g ethylacetate at 40° C. The obtained solution was added under stirring to 45 cc of an aqueous solution of gelatin A at 10% by weight containing 0.4 g of the anionic surfactant Nekal TM BX, the mixture then being dispersed by means of a rotatory homogenizer to give 100 g of dispersion 2.

Cyan coupler A:

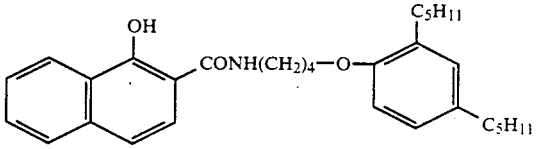

Cyan coupler B:

-continued

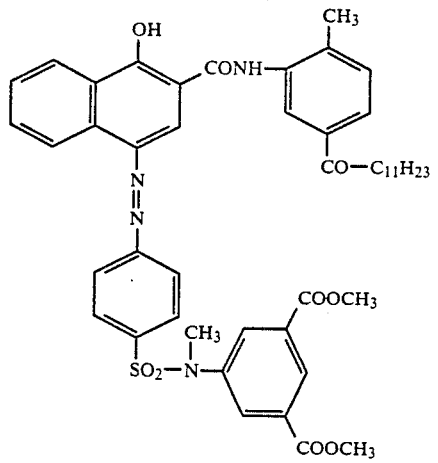

The dinamic and static surface tension of the coating composition forming, after coating, the second layer of each film was measured according to Communication No. 1851H form Kodak Research laboratories published under the title "A direct reading electrically operated balance for static and dynamic surface tension measurement".

The estimate of the degree of overall coating quality was graded into 3 steps as follows:

4 coating to be rejected 6 coating acceptable but with scraps 8 coating 100% acceptable The following Table 1 reports the values of static and dynamic surface tension of the coating composition expressed in N/m (Newton/ meter) and the estimate of the coating quality of each film.

TABLE 1

| Film | Surface static | Tension dynamic | Coating Quality |
|---|---|---|---|
| A (comparison) | 34 | 34 | 4 |
| B (comparison) | 32 | 32.5 | 4 |
| C (invention) | 29 | 29.5 | 8 |
| D (comparison) | 39 | 39 | 4 |
| E (invention) | 29 | 30 | 8 |

As is evident from Table 1, the combination of surface active agents according to this invention allows a reduction of surface tension of the coating composition and improves the coating quality of the film. The same results as those of films C and E were obtained using instead of Tegobetaine TM L7 the following surface active agents in combination with the anionic surface active agent:

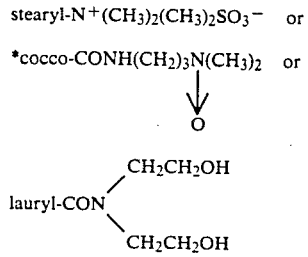

We claim:

1. A multilayer photographic element comprising a support having coated thereon a plurality of hydrophilic colloid layers comprising at least one hydrophilic colloid silver halide emulsion layer and at least one hydrophilic colloid auxiliary layer, characterized in that at least one hydrophilic colloid auxiliary layer comprises at least three components, a) an anionic surface active agent, b) at least one of betaine, N-oxide or amide surface active agents, and c) at least one of dispersed droplets of a water-immiscible high-boiling organic solvent, a vinyl addition polymer latex and a highly deionized gelatin.

2. A multilayer photographic element according to claim 1, wherein said anionic surface active agent corresponds to the formula

R—A—X wherein

R represents a hydrocarbon group,

A is a chemical bond or a divalent organic residue, and

X represents an anionic group.

3. A multilayer photographic element according to claim 1, wherein said betaine, N-oxide or amide surface active agent corresponds to the formula

R—A—Y wherein

R represents a hydrocarbon group,

A is a chemical bond or a divalent organic residue, and

Y represents a hydrophilic betaine, N-oxide or amide group.

4. A multilayer photographic element according to claim 1, wherein said anionic surface active agent is contained in said hydrophilic colloid auxiliary layer in a quantity ranging from 2 to 5 g per 100 g of hydrophilic colloid.

5. A multilayer photographic element according to claim 1, wherein said betaine, N-oxide or amide surface active agent is contained in said hydrophilic colloid auxiliary layer in a quantity ranging from 1 to 4.5 g per 100 g of hydrophilic colloid.

6. A multilayer photographic element according to claim 1, wherein said organic solvent has a boiling point exceeding 200° C. and a water solubility of less than 0.5 g per liter at 25° C.

7. A multilayer photographic element according to claim 1, wherein said organic solvent is chosen from the class consisting of dibuthylphthalate, tricresylphosphate, triphenylphosphate, di-2-ethylhexylphthalate, di-n-octylphthalate, tris-2-ethylexylphosphate, cetyltributylcitrate, di-n-hexyladipate, dimethylsebacate, triethyleneglycol-di-2-ethylhexoate, ethylphthalylethylglycolate, quinitol-bis(2-ethylhexoate) and 1,4-cyclohexyldimethylene-bis-(2-hexylhexoate).

8. A multilayer photographic element according to claim 1, wherein said dispersed droplets have an average size of between 0.1 and 1 μm.

9. A multilayer photographic element according to claim 1, wherein said vinyl addition polymer has a glass transition temperature of less than 25° C.

10. A multilayer photographic element according to claim 1, wherein said vinyl addition polymer is chosen from the class comprising polymethylacrylate, polyethylacrylate, polybutylacrylate, polyethoxyethylacrylate, polyhexyl acrylate, polyethylhexylacrylate, polybutylmethacrylate and polyethoxyethylmethacrylate.

11. A multilayer photographic element according to claim 1, wherein said vinyl addition polymer latex comprise particles having an average size of between 0.03 and 0.4 μm.

12. A multilayer photographic element according to claim 1, wherein said highly deionized gelatin has a $Ca^{++}$ content lower than 50 ppm.

* * * * *

UNITED STATES PATENT AND TRADEMARK OFFICE

CERTIFICATE OF CORRECTION

PATENT NO. : 5,037,729

DATED : August 6, 1991

INVENTOR(S) : Fulvio Furlan et al.

It is certified that error appears in the above-identified patent and that said Letters Patent is hereby corrected as shown below:

Col. 1, line 28 "viscositY" should be --viscosity--

Col. 2, line 52 "R-A13X" should be --R-A-X--

Col. 3, line 22 "betained" should be --betaine--

Signed and Sealed this

Twenty-second Day of February, 1994

*Attest:*

Bruce Lehman

BRUCE LEHMAN

*Attesting Officer*

*Commissioner of Patents and Trademarks*